US009966718B2

(12) United States Patent
Chen et al.

(10) Patent No.: US 9,966,718 B2
(45) Date of Patent: May 8, 2018

(54) BULB APPARATUS

(71) Applicant: XIAMEN LEEDARSON LIGHTING GROUP CO., LTD., Xiamen (CN)

(72) Inventors: Xiaobo Chen, Xiamen (CN); Maojin Zeng, Xiamen (CN); Yongzhe Dong, Xiamen (CN); Liangliang Cao, Xiamen (CN); Ruifang Ma, Xiamen (CN); Guijuan Song, Xiamen (CN); Jiezhen Zhang, Xiamen (CN); Jianghuai Li, Xiamen (CN)

(73) Assignee: XIAMEN LEEDARSON LIGHTING GROUP CO., LTD., Xiamen (CN)

( * ) Notice: Subject to any disclaimer, the term of this patent is extended or adjusted under 35 U.S.C. 154(b) by 0 days. days.

(21) Appl. No.: 15/192,878

(22) Filed: Jun. 24, 2016

(65) Prior Publication Data

US 2016/0380400 A1 Dec. 29, 2016

(30) Foreign Application Priority Data

Jun. 25, 2015 (CN) ..... 2015 1 0355451

(51) Int. Cl.

| | |
|---|---|
| ***H01R 33/22*** | (2006.01) |
| ***F21K 9/235*** | (2016.01) |
| ***F21K 9/238*** | (2016.01) |
| *F21Y 115/10* | (2016.01) |
| *H01R 33/945* | (2006.01) |

(52) U.S. Cl.

CPC ..... *H01R 33/22* (2013.01); *F21K 9/235* (2016.08); *F21K 9/238* (2016.08); *F21Y 2115/10* (2016.08); *H01R 33/9453* (2013.01)

(58) Field of Classification Search

CPC ..... F21K 9/235; F21K 9/238; H01R 33/22; H01R 33/9453; F21Y 2115/10

See application file for complete search history.

(56) References Cited

U.S. PATENT DOCUMENTS

| | | | | |
|---|---|---|---|---|
| 2009/0196016 A1* | 8/2009 | Massara | ..... | F21V 23/0471 362/86 |
| 2014/0049957 A1* | 2/2014 | Goelz | ..... | F21V 29/763 362/235 |
| 2016/0018087 A1* | 1/2016 | Gielen | ..... | F21V 17/005 362/249.01 |

* cited by examiner

*Primary Examiner* — Kevin Quarterman
(74) *Attorney, Agent, or Firm* — Chun-Ming Shih

(57) ABSTRACT

A bulb apparatus includes a driver plate and a bulb head body. The bulb head body is a housing structure with top opening. The sidewall of the bulb head body forms a first electrode terminal. The bottom of the driver plate is placed inside the bulb head body. The bulb apparatus also includes a connection base and a first electrode. The connection base is fixed on the driver plate. The connection base has an embedding trench. The first electrode has a fixing end electrically connected to the driver plate via the embedding trench and a connecting end elastically abutting on the inner sidewall of the first electrode terminal.

11 Claims, 2 Drawing Sheets

BULB APPARATUS

FIELD OF INVENTION

The present invention is related to an illumination device and more particularly related to a bulb device.

BACKGROUND

With growing global eco-conscious, LED illumination devices gain wide support and have fast development. Current bulb structures usually need manual welding between bulb head electrodes and driver plates. Such manufacturing approach takes large cost and makes product manufacturing complicated and hard to be performed automatically.

SUMMARY OF INVENTION

With such need, an object of the present invention is to provide a bulb structure that is easily to be assembled and even manufactured automatically with robots.

An embodiment of the present invention is a bulb apparatus having a driver plate and a bulb head body. The bulb head body is a housing structure with a top opening. A sidewall of the bulb head body forms a first electrode terminal. A bottom of the driver plate is placed inside the bulb head body. The bulb apparatus also has a connection base and a first electrode. The connection base is fixed on the driver plate. An embedding trench is disposed on the connection base. The first electrode has a fixing end and a connecting end. The fixing end of the first electrode is electrically connected to the driver plate through the embedding trench. The connecting end of the first electrode is an elastic structure. The connecting end of the first electrode abuts on the inner sidewall of the first electrode terminal.

Compared with conventional art, the bulb apparatus has a socket base on the driver plate. A first electrode is provided on the socket base and a fixing end of the first electrode is electrically connected to the driver plate. When assembling the bulb apparatus, it is only needed to elastically abut the connecting end of the first electrode on the sidewall of the first electrode terminal to achieve electrical connection without the need of welding. Therefore such bulb apparatus is easily assembled and saves the cost of welding. It is also easier to design an automatic manufacturing process for such bulb apparatus.

DETAILED DESCRIPTION

The present invention is explained as follows with detailed examples and associated drawings.

Figure 1:
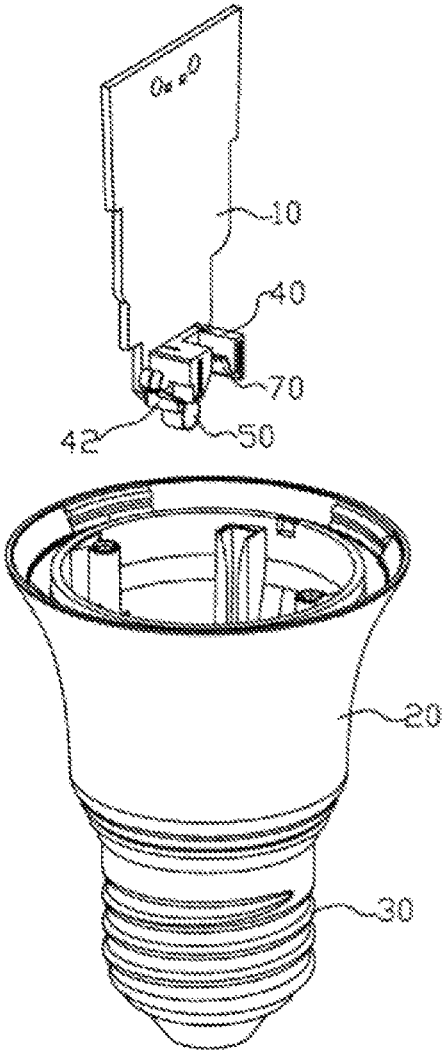
FIG. 1 is a perspective exploded diagram of a first embodiment of the bulb apparatus according to the present invention.

FIG. 1 is a perspective exploded diagram of a bulb apparatus of a first embodiment according to the present invention. The bulb apparatus includes a driver plate 10 and a bulb head body 20. The bulb head body 20 is a housing structure with a top opening. The sidewall of the bulb head body 20 forms a first electrode terminal 30. The bottom of the driver plate 10 is placed inside the bulb head body 20. The bulb apparatus also includes a connection base 40 and a first electrode 50.

Figure 3:
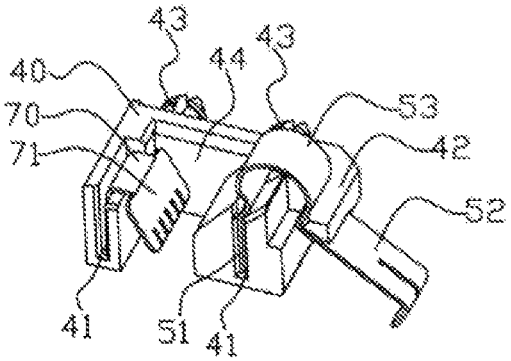
FIG. 3 is a perspective view of a socket base of the bulb apparatus of FIG. 2.
Figure 4:
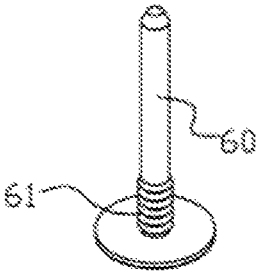
FIG. 4 is a perspective view of a second electrode terminal of FIG. 2.

Please refer to FIG. 3 and FIG. 4. The connection base 40 is fixed on the driver plate 20. Specifically, the connection base 40 has one or more than installation columns 43. The installation columns 43 have free ends with anti-loose elastic barbs. Installation through holes (not shown) are provided on the driver plate 10. The install columns 32 are inserted into the installation through holes (not shown) for hooking the anti-loose elastic barbs 431 on the driver plate 10 so as to fix the connection base 40 on the driver plate 10. The connection base 40 may be made of insulation material.

An embedding trench 41 is provided on the connection base 40. The first electrode 50 has a fixing end 51 and a connecting end 52. The fixing end 51 of the first electrode extends through the embedding trench 41 to electrically connect to the driver plate 10. In this embodiment, the fixing end 51 of the first electrode 50 is a plug need structure. A plug hole is provided on the driver plate 10. The fixing end 51 extends through the embedding trench 41 to be welded in the plug hole so as to be electrically connected to the driver circuit on the driver plate 10. The connecting end 52 of the first electrode 50 is an elastic structure. Preferably, the connecting 52 of the first electrode is a bended metal elastic spring strip structure. Furthermore the tail of the connecting end 52 of the first electrode may be a comb structure. The connecting end 52 of the first electrode elastically abuts on the inner sidewall of the first electrode terminal 30. A buffer portion 53 is smoothly provided between the fixing end 51 and the connecting end 52 of the first electrode 50. The buffer portion may be a 'U' arc shape structure. The buffer portion may reserve force. The buffer portion 53 provides a larger elastic deformation space when the connecting end 52 of the first electrode 50 abuts on the inner sidewall of the first electrode terminal 30 so as to ensure reliability of the connecting end 52 and facilitate assembling of the first electrode 50. Besides, a blocking lever 42 may be disposed on the connection base 40. The blocking lever 42 abuts on the bended portion of the connecting end 52 to limit deformation of the connecting end 52.

Figure 2:
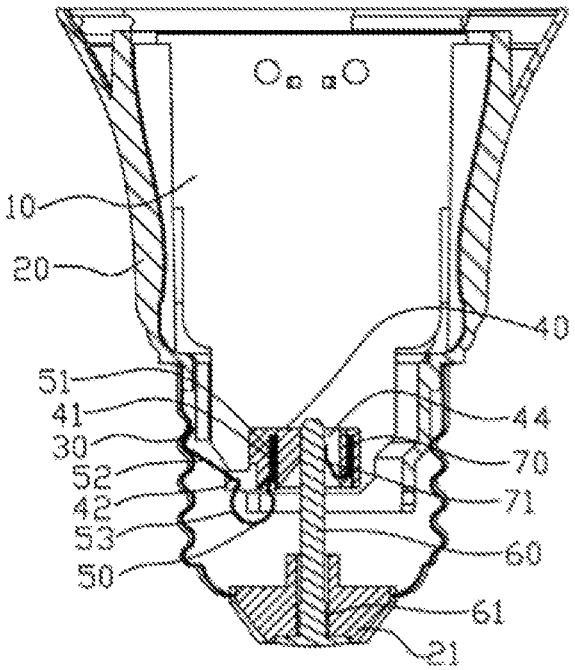
FIG. 2 is a section view of the bulb apparatus of FIG. 1.

Please refer to FIG. 2 and FIG. 4. The bulb apparatus further includes a second electrode terminal 50 and a second electrode 70. The second electrode 70 is fixed on the connection base 40. One end of the second electrode 70 is electrically connected to the driver plate 10. The other end of the second electrode 70 is an elastic connecting end 71. One end of the second electrode terminal 60 is fixed on the bulb head body 20 and insulated from the first electrode terminal 30. In this embodiment, one end of the second electrode terminal 60 has a teeth structure 61. An insulation ring 21 is placed on the bulb head body 20. The insulation ring 21 is fixed at the bottom of the second electrode terminal 60. The second electrode terminal 60 use the teeth structure 61 to hook on the insulation ring 21. The other end of the second electrode terminal 60 is electrically connected to the elastic connecting end 71 of the second electrode 70. Specifically, the connection base 40 has a groove 44 in its middle portion. The elastic connecting end 71 of the second electrode 70 extends into the groove 44. The other end of the second electrode terminal 60 extends into the groove 44 and abuts between the inner sidewall of the groove 44 and the elastic connecting end 72 of the second electrode 70 so as to ensure reliable connection between the second electrode terminal 60 and the second electrode 70.

In summary, the bulb apparatus has a connection base 40 as a socket base. The connection base 40 is fixed on the driver plate 10. A first electrode 50 is placed on the connection base 40. The fixing end 51 of the first electrode 50 is electrically connected to the driver plate 10. During assembling, it is only needed to elastically abut the connecting end 52 of the first electrode on the sidewall of the first electrode terminal 30 to achieve electrical connection of the bulb apparatus. Such design ensures low cost of assembling, prevents complicated structures and facilitates automation process.

In another embodiment, the driver plate has a base plate and a driver circuit on the base plate. The driver plate and the connection base may be made separately and assembled with the aforementioned structure or other structures. Alternatively, the driver plate and the connection base may be manufactured as a unibody. In other words, the connection base may be made as a portion of the driver plate.

In another embodiment, the bulb head body may be used for containing a LED module to form a LED bulb. Alternatively, other circuits may be provided on the driver plate as mentioned above. With or without LED modules, the driver plate may provide function depending on what circuits are provided on the driver plate. In other words, the bulb apparatus is not limited to illumination devices. With a compatible socket structure, such bulb apparatus may be designed to have functions other than LED bulbs. For example, an audio device, a network device, a smoke detection device, a human detection device or other electronic device like IoT (Internet of Things) devices. With the bulb head body structure, such device may be easily installed on general purpose bulb socket to get power supply to the electronic devices installed on the bulb head portion.

The above mentioned are only preferred specific examples of this application, and are not thence restrictive to the scope of claims of this application. Therefore, those who apply equivalent changes incorporating contents from this application are included in the scope of this application, as stated herein.

The invention claimed is:

1. A bulb apparatus comprising:

a driver plate;

a bulb head body, wherein the bulb head body is a housing structure with a top opening, a sidewall of the bulb head body forms a first electrode terminal, and the bottom of the driver plate is disposed in the inner side of the bulb head body;

a first electrode; and a connection base fixed on the driver plate, wherein an embedding trench is provided on the connection base;

wherein the first electrode having a fixing end and a connecting end, wherein the fixing end of the first electrode is electrically connected to the driver plate through the embedding trench, the connecting end of the first electrode is an elastic structure, and the connecting end of the first electrode is abutting on an inner sidewall of the first electrode terminal;

wherein an installation column is disposed on the connection base, a free end of the installation column is provided with an anti-loose elastic barb, an installation through hole is provided on the driver plate, the installation column is inserted into the through hole to hook the driver plate with the elastic barb so as to fix the connection base on the driver plate.

2. The bulb apparatus of claim 1, wherein the connecting end of the first electrode is a bended metal elastic spring strip structure.

3. The bulb apparatus of claim 2, wherein the fixing end of the first electrode is a plug needle structure, the driver plate is provided with a plug hole, and the fixing end of the first electrode is welded in the plug hole through the embedding trench to be electrically connected to a driver circuit on the driver plate.

4. The bulb apparatus of claim 2, wherein the connecting end of the first electrode has a tail with a comb structure.

5. The bulb apparatus of claim 2, wherein a blocking lever is disposed on the connection base abutting on a bended portion of the connecting end of the first electrode to limit deformation of the connecting end.

6. The bulb apparatus of claim 1, further comprising a second electrode terminal and a second electrode, wherein the second electrode is fixed on the connection base, one end of the second electrode is electrically connected to the driver plate, the other end of the second electrode is an elastic connecting end, one end of the second electrode terminal is fixed to the bulb head body and is insulated from the first electrode terminal, and the other end of the second electrode terminal is electrically connected to the elastic connecting end of the second electrode.

7. The bulb apparatus of claim 6, wherein one end of the second electrode terminal is provided with a teeth structure, an insulation ring is disposed on the bulb head body, the insulation ring is fixed at the bottom of the first electrode terminal, and the second electrode terminal is hooked on the insulation ring via the teeth structure.

8. The bulb apparatus of claim 1, wherein the connection base is made of insulation material.

9. The bulb apparatus of claim 1, wherein a buffer portion is smoothly provided between the fixing end and the connecting end of the first electrode, and the buffer portion is a 'U' arc shape structure.

10. The bulb apparatus of claim 6, wherein a middle portion of the connection base is provided with a groove, the elastic connecting end of the second electrode extends into the groove, the other end of the second electrode extends into the groove and abuts between an inner side wall of the groove and the elastic connecting end of the second electrode.

11. The bulb apparatus of claim 1, further comprising a LED module driven by the driver plate.

* * * * *